United States Patent [19]

Bailey

[11] 4,213,711

[45] Jul. 22, 1980

[54] FLUID MIXING DEVICES

[76] Inventor: Thomas G. Bailey, 91, Salisbury Ave., Warden Hill, Cheltenham, England

[21] Appl. No.: 25,602

[22] Filed: Mar. 30, 1979

[30] Foreign Application Priority Data

Mar. 30, 1978 [GB] United Kingdom ..... 12376/78

[51] Int. Cl.[2] ..... B01F 15/02

[52] U.S. Cl. ..... 366/150; 366/131; 366/177

[58] Field of Search ..... 366/150, 131, 177, 182, 366/175, 160, 163, 167; 137/604

[56] References Cited

U.S. PATENT DOCUMENTS

| | | | |
|---|---|---|---|
| 3,068,075 | 12/1962 | Boekemeier | 366/150 X |
| 3,218,039 | 11/1965 | Baer | 366/177 |
| 3,462,128 | 8/1960 | Dallois | 366/131 |
| 4,165,187 | 8/1979 | James | 366/150 |

*Primary Examiner*—Edward J. McCarthy
*Attorney, Agent, or Firm*—Young & Thompson

[57] ABSTRACT

A fluid mixing device comprises a body part having an inlet for water under pressure, a main flow passage leading from the inlet to an outlet, the main flow passage being shaped to create a low pressure zone therein, and an auxiliary passage leading to the low pressure zone from a source of liquid detergent. The main flow passage is divided into two subsidiary passages downstream of the low pressure zone, and is formed in a valve member which is rotatable to prevent flow of fluid through at least one of said subsidiary passages, when required, thereby reducing the effective cross-sectional area of the main flow passage and creating back pressure which fills the low pressure zone and renders it ineffective in drawing the detergent into the main flow passage.

9 Claims, 4 Drawing Figures

FLUID MIXING DEVICES

BACKGROUND OF THE INVENTION

The invention relates to fluid mixing devices and particularly to devices suitable for mixing a liquid detergent with a stream of water.

In particular the invention relates to a fluid mixing device of the kind comprising a body part having an inlet for connection to a source of a first fluid, such as water, under pressure, a main flow passage leading from said inlet to an outlet from the body part, means within the main flow passage for creating a low pressure zone in that passage during flow of the first fluid therethrough, and an auxiliary passage leading to said low pressure zone and for connection to a source of a second fluid, such as liquid detergent. In such a device, the creation of the low pressure zone due to the flow of the first fluid causes the second fluid to be drawn into the main flow passage and to be entrained with the first fluid so that the two fluids emerge together from the outlet of the device.

In a device of this kind it is desirable to be able to cut off the supply of the second fluid when required. Hitherto, this has been achieved by providing a valve controlled vent leading to the main flow passage, by means of which vent the low pressure zone may be placed in communication with the ambient atmosphere. Since, when the vent is opened, ambient air is more easily drawn into the low pressure zone than is the second fluid, the flow of the second fluid will cease. Such an arrangement has the disadvantage that the provision of the air vent, and its associated control valve, is costly, and the device is also liable to malfunction due to leakage in the air valve assembly. The invention sets out to provide a fluid mixing device which avoids these drawbacks.

SUMMARY OF THE INVENTION

According to the invention a fluid mixing device of the kind first referred to includes adjustable means for selectively reducing the cross-sectional area of said main flow passage, downstream of said low pressure zone, to an extent whereby, in use of the device, the low pressure zone is ineffective in drawing the second fluid into the main flow passage.

In the device according to the invention, reducing the cross-sectional area of the main flow passage has the effect of creating a back pressure upstream of the reduction. This back pressure causes the low pressure zone to fill with the first fluid and/or to be displaced along the main flow passage to a position where it is out of communication with the auxiliary passage.

The main flow passage may be divided into a plurality of subsidiary passages downstream of the low pressure zone, and said means for reducing the cross-sectional area of the main flow passage may comprise valve means operable to prevent flow of fluid through at least one of said subsidiary passages. For example, said subsidiary passages may be formed in an element movable with respect to the body part from a first position where all the subsidiary passages are in communication with a downstream portion of the main flow passage, and a second position where at least one of the subsidiary passages is cut off from communication with said downstream portion.

The aforesaid means for creating a low pressure zone within the main flow passage may comprise a stepped portion of the main flow passage where two concentric circular bores of different diameters have an annular shoulder therebetween.

DETAILED DESCRIPTION OF THE PREFERRED EMBODIMENTS

Figure 1:
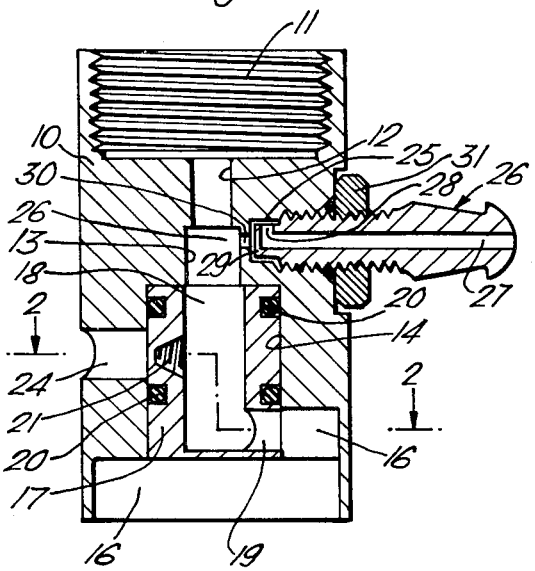
FIG. 1 is a vertical section through a fluid mixing device suitable for mixing liquid detergent in a stream of water.
Figure 2:
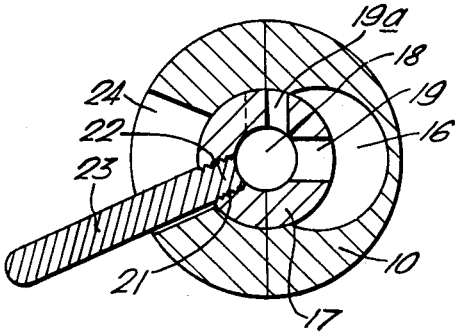
FIG. 2 is a section on the line 2—2 of FIG. 1.

Referring to FIGS. 1 and 2, the main body part 10 of the device is formed with a circular internally threaded recess 11 at its upper end by means of which the device may be fitted to a water supply nozzle. Leading downwardly from the bottom of the recess 11 is a main flow passage comprising a narrow bore 12 which leads into a larger diameter bore 13 which in turn leads into a still larger diameter bore 14. A peripheral skirt 15 extends downwardly from the lower end of the body part, and an exit chamber 16 is formed in the wall of the body part adjacent the lower end of the bore 14 and communicates with that bore. The combination of the skirt 15 and the exit chamber 16 produces the required divergent foaming spray.

Received within the bore 14 is a cylindrical valve member 17. The valve member 17 comprises a central bore 18 the lower end of which is closed. Exit passageways 19, 19*a*, disposed at right angles to one another, extend radially from the lower end of the bore 18 to the external surface of the valve member. The valve member is provided with peripheral grooves which receive O-rings 20 which provide a fluid-tight seal between the valve member 17 and the walls of the bore 14.

Between the peripheral grooves, the valve member is formed with a threaded radial hole 21 which, when the valve member 17 is in position in the bore 14, receives the threaded end 22 of a valve lever 23. The valve lever 23 extends through a radial slot 24 in the wall of the main body part 10, the horizontal angular extent of the slot 24, as shown in FIG. 2, being such as to permit limited rotational movement of the valve member 17 within the bore 14.

The positions of the exit passageways 19, 19*a* in the valve member 17 are such that when the valve lever 23 is at one extremity of the slot 24, both passageways communicate with the exit chamber 16, but when the valve lever is at the opposite extremity of the slot only the exit passageway 19 communicates with the exit chamber 16. It will thus be appreciated that the effective cross-sectional area of the main flow passage through the device may be reduced by angular movement of the valve lever 23 to rotate the valve member 17 to the position thereof where flow takes place only through the passageway 19.

An auxiliary inlet passage 25 is formed in the wall of the body part 10, and leads to an area 26 of the bore 13 adjacent the annular shoulder between the bore 13 and the bore 12. Threadedly received within the auxiliary passage 25 is an adjustment nozzle 26. The adjustment nozzle 26 is connected to a source of liquid detergent and has a central bore 27 through which the liquid detergent is delivered. The central bore has adjacent the closed end thereof a radial aperture 28. By rotating the nozzle 26 in the threaded passage 25, the end face 29 of the nozzle may be brought closer to or further from a narrow passage 30 which places the end of the auxiliary passage 25 in communication with the bore 13 so as to meter the amount of liquid detergent flowing through the nozzle into the low pressure area 26 of the bore 13. The nozzle 26 is secured in the position to which it has been set by a locking nut 31.

In operation of the device, the flow of water from the smaller diameter bore 12 to the larger diameter bore 13 creates a low pressure zone 26 and this causes liquid detergent to be drawn through the adjustment nozzle 26 into the low pressure zone where it becomes entrained with the water flowing through the device. This occurs when the valve member 17 is in the position where both passageways 19, **19*a* are in communication with the exit chamber 16. By rotating the valve member 17, by means of the lever 23, to cut off passage 19*a* from the exit chamber 16, as shown in FIG. 2, the effective cross-sectional area of the flow passage is reduced and the low pressure zone 26 becomes ineffective in drawing liquid detergent into the main flow passage. The closing-off of the passageway 19*a* causes a back pressure in the bores 18, 13 and 12, so that the low pressure zone 26 fills with water. The cross-sectional area of the passageways 19, 19*a* is so selected that the back pressure is only sufficient to fill the low pressure zone and is not sufficient to force water back along the nozzle 26. Conversely, the cross-sectional area of the passageways 19, 19*a* is also such that when water is being discharged through both passageways the bore 18 is maintained full of water to prevent air travelling up into the low pressure zone 26**.

Figure 3:
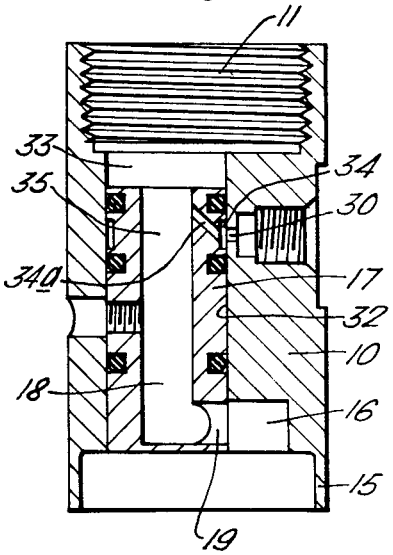
FIG. 3 is a vertical section through an alternative form of fluid mixing device.
Figure 4:
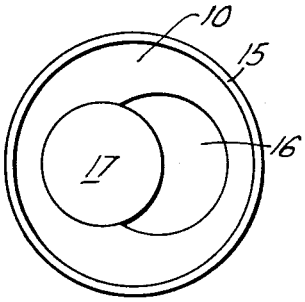
FIG. 4 is an underneath view of the device of FIG. 3.

FIGS. 3 and 4 show a modified version of the device of FIGS. 1 and 2, and like reference numerals are used for corresponding components. In the modified arrangement the stepped bores 12, 13, 14 are replaced by a single bore 32 and the length of the valve member 17 is increased so that it extends across the narrow passage 30 leading from the adjustment nozzle 26 (not shown in FIG. 3). The upper end face of the valve member 17 is spaced below the upper end of the bore 32 to provide a large diameter zone 33.

An annular peripheral groove 34 is formed in the outer surface of the valve member 17, opposite the narrow passage 30, and an inclined passage **34*a* extends upwardly from the groove 34 to a zone 35 at the upper end of the bore 18 in the valve member 17. The inclined passage 34*a* thus remains in communication with the passage 30** as the valve member is rotated.

With this arrangement the zone 35 is a low pressure zone, but the low pressure arises because of a different effect to that in the arrangement shown in FIG. 1. The arrangement shown in FIG. 3 provides a "vena contracta" at the upper end of the bore 18. The advantage of this arrangement is that the low pressure zone is formed at lower rates of water flow than is the case with the previously described arrangement, and also the effect occurs more in proportion to the rate of water flow. As in the previously described arrangement the reduction in the cross-sectional area of the main flow passage, by rotation of the valve member 17, renders the low pressure zone ineffective in drawing liquid detergent into the passage. In this case it is believed that the reduction in flow, as well as tending to cause the low pressure zone to fill, also tends to displace the zone in the bore 18 so that it moves out of communication with the narrow passage 30.

In an alternative arrangement, not shown, the upper end portion of the bore 18 may be of increased diameter to form the zone 35.

It will be appreciated that many variants of the above-described devices are possible. For example the device may be designed as in-line units. Also, the central valve member may be arranged to be electrically operated instead of manually operated as shown.

I claim:

1. A fluid mixing device comprising: a body part; an inlet in the body part for connection to a source of a first fluid under pressure; an outlet from the body part; a main flow passage leading from said inlet to said outlet; means within the main flow passage for creating a low pressure zone in that passage during flow of the first fluid therethrough; an auxiliary passage leading to said low pressure zone; means for connecting the auxiliary passage to a source of a second fluid; and adjustable means for selectively reducing the cross-sectional area of said main flow passage, downstream of said low pressure zone, to an extent whereby, in use of the device, the low pressure zone is ineffective in drawing the second fluid into the main flow passage.

2. A fluid mixing device according to claim 1, wherein the main flow passage is divided into a plurality of subsidiary passages downstream of the low pressure zone, and said means for reducing the cross-sectional area of the main flow passage comprises valve means operable to prevent flow of fluid through at least one of said subsidiary passages.

3. A fluid mixing device according to claim 2, wherein said subsidiary passages are formed in an element movable with respect to the body part from a first position where all the subsidiary passages are in communication with a downstream portion of the main flow passage, and a second position where at least one of the subsidiary passages is cut off from communication with said downstream portion.

4. A fluid mixing device according to claim 3, wherein said movable element comprises a valve member rotatable in said body part and having an axial passage forming part of said main flow passage, and wherein said subsidiary passages extend transversely from said axial passage, and said downstream portion of the main flow passage comprises a chamber in the body part, all of the subsidiary passages being in communication with said chamber in said first position of the valve member, and at least one of the subsidiary passages being cut off from communication with said chamber in said second position of the valve member.

5. A fluid mixing device according to claim 1, wherein said means for creating a low pressure zone within the main flow passage comprises a stepped portion of the main flow passage where two concentric circular bores of different diameters have an annular shoulder therebetween.

6. A fluid mixing device according to claim 5, wherein said concentric circular bores comprise a smaller diameter bore in communication with said inlet and a larger diameter bore connected to said smaller diameter bore by said annular shoulder, said auxiliary passage being in communication with a part of said larger diameter bore adjacent said shoulder.

7. A fluid mixing device according to claim 5, wherein said concentric circular bores comprise a larger diameter bore in communication with said inlet and a smaller diameter bore connected to said larger diameter bore by said annular shoulder, said auxiliary passage being in communication with a part of said smaller diameter bore adjacent said shoulder.

8. A fluid mixing device according to claim 4, wherein said means for creating a low pressure zone within the main flow passage comprises a larger diameter bore in communication with said inlet and a smaller diameter bore connected to said larger diameter bore by an annular shoulder, said auxiliary passage being in communication with a part of said smaller diameter bore adjacent said shoulder, and wherein the axial passage in the valve member constitutes said smaller diameter bore and the valve member is formed with a connecting passage placing said axial passage in communication with said auxiliary passage.

9. A fluid mixing device according to claim 8, wherein said connecting passage leads from said axial passage to an annular groove extending around the outer periphery of the valve member, said auxiliary passage being in communication with said groove.

* * * * *